US012577689B2

(12) United States Patent
Fujii et al.

(10) Patent No.: US 12,577,689 B2
(45) Date of Patent: Mar. 17, 2026

(54) CATHODE ELECTRODE, COMPOSITE OF CATHODE ELECTRODE AND SUBSTRATE, AND METHOD OF MANUFACTURING COMPOSITE OF CATHODE ELECTRODE AND SUBSTRATE

(71) Applicants: RIKEN, Saitama (JP); CHIYODA CORPORATION, Kanagawa (JP); FURUKAWA ELECTRIC CO., LTD., Tokyo (JP)

(72) Inventors: Katsushi Fujii, Saitama (JP); Kayo Koike, Saitama (JP); Ryuhei Nakamura, Saitama (JP); Satoshi Wada, Saitama (JP); Dai Takeda, Kanagawa (JP); Jun Matsumoto, Kanagawa (JP); Eri Torikai, Kanagawa (JP); Takahiro Yamamoto, Tokyo (JP); Yu Mimura, Tokyo (JP); Kiyoshi Yamamoto, Tokyo (JP); Shinsuke Nishida, Tokyo (JP)

(73) Assignees: RIKEN, Saitama (JP); CHIYODA CORPORATION, Kanagawa (JP); FURIKAWA ELECTRIC CO., LTD., Tokyo (JP)

( * ) Notice: Subject to any disclaimer, the term of this patent is extended or adjusted under 35 U.S.C. 154(b) by 421 days.

(21) Appl. No.: 17/815,149

(22) Filed: Jul. 26, 2022

(65) Prior Publication Data

US 2022/0356588 A1 Nov. 10, 2022

Related U.S. Application Data

(63) Continuation of application No. PCT/JP2021/002440, filed on Jan. 25, 2021.

(30) Foreign Application Priority Data

Jan. 27, 2020 (JP) ..... 2020-010873

(51) Int. Cl.
*C25B 3/26* (2021.01)
*C25B 3/03* (2021.01)
(Continued)

(52) U.S. Cl.
CPC ..... *C25B 3/26* (2021.01); *C25B 3/03* (2021.01); *C25B 3/07* (2021.01); *C25B 11/093* (2021.01)

(58) Field of Classification Search
None
See application file for complete search history.

(56) References Cited

U.S. PATENT DOCUMENTS

2015/0111975 A1* 4/2015 Goto ..... B01J 37/08 502/245
2017/0243700 A1 8/2017 Park et al.
(Continued)

FOREIGN PATENT DOCUMENTS

CN 108823588 A 11/2018
JP H01176086 A 7/1989
(Continued)

OTHER PUBLICATIONS

Lee et al ("Importance of Ag—Cu Biphasic Boundaries for Selective Electrochemical Reduction of CO 2 to Ethanol", ACS Catal. Jul. 12, 2017, 8594-8604). (Year: 2017).*
(Continued)

*Primary Examiner* — Alexander W Keeling
(74) *Attorney, Agent, or Firm* — Dorsey & Whitney LLP

(57) ABSTRACT

The present disclosure provides a cathode electrode that can stably sustain a catalytic reaction producing an olefinic hydrocarbon such as ethylene and an alcohol such as ethanol by a reduction reaction of carbon dioxide over a long term. A cathode electrode that electrically reduces carbon dioxide, including cuprous oxide, copper, and at least one additional
(Continued)

BEFORE PARTIAL REDUCTION TREATMENT (AFTER COELECTRODEPOSITION TREATMENT)

AFTER PARTIAL REDUCTION TREATMENT metal element selected from the group consisting of silver, gold, zinc, and cadmium.

13 Claims, 7 Drawing Sheets

(51) Int. Cl.
*C25B 3/07* (2021.01)
*C25B 11/093* (2021.01)

(56) References Cited

U.S. PATENT DOCUMENTS

| | | | |
|---|---|---|---|
| 2019/0030523 A1 | 1/2019 | Chen et al. | |
| 2019/0177863 A1 | 6/2019 | Khaled et al. | |
| 2022/0119966 A1* | 4/2022 | Chen | C25B 11/091 |

FOREIGN PATENT DOCUMENTS

| | | | |
|---|---|---|---|
| JP | H1080636 | A | 3/1998 |
| JP | 2018024895 | A | 2/2018 |
| JP | 2018034090 | A | 3/2018 |
| JP | 2018168410 | A | 11/2018 |
| JP | 2019026551 | A | 2/2019 |
| JP | 2019108575 | A | 7/2019 |
| WO | 2016134952 | A1 | 9/2016 |
| WO | 2021153503 | A1 | 8/2021 |

OTHER PUBLICATIONS

Yuan et al ("Photoelectrocatalytic reduction of carbon dioxide to methanol at cuprous oxide foam cathode", RSC Adv., Jul. 2017, 24933-24939). (Year: 2017).*

Janaky et al ("Electro- and Photoreduction of Carbon Dioxide: The Twain Shall Meet at Copper Oxide/Copper Interfaces", ACS Energy Lett. Jan. 2, 2016, 332-338). (Year: 2016).*

Manthiram et al ("Enhanced Electrochemical Methanation of Carbon Dioxide with a Dispersible Nanoscale Copper Catalyst", J. Am. Chem. Soc. 2014, 136, 38, 13319-13325). (Year: 2014).*

Habibi et al ("Fabrication and Characterization of CuO—ZnO—Cu2O Nano-Composites by Sol-Gel Route: Effect of Calcinations Temperature", Synthesis and Reactivity in Inorganic, Metal-Organic, and Nano-Metal Chemistry, vol. 44, 2014—Issue 9). (Year: 2014).*

Extended European Search Report mailed Jun. 27, 2024 in EP Application No. 21747112.7; pp. all.

Hou et al. "Three-Dimensional Bimetal-Graphene-Semiconductor Coaxial Nanowire Arrays to Harness Charge Flow for the Photochemical Reduction of Carbon Dioxide"; Angewandte Chemie International Edition; vol. 54, No. 29, Jun. 9, 2015; pp. 8480-8484.

[English Translation] Second Notice of Examination Opinion for Chinese Patent Application No. 202180011402.X dated May 29, 2024, pp. all.

Wang, Mengyun , et al., "Facile synthesis of hierarchical flower-like Ag/Cu2O and Au/Cu2O nanostructures and enhanced catalytic performance in electrochemical reduction of CO2", Research Article, vol. 14, Issue 5,, pp. 813-823.

Hori, Yoshio , et al., "Electrochemical Reduction of CO at a Copper Electrode", J. Phys. Chem. B, vol. 101, 1997, pp. 7075-7081.

International Search Report and Written Opinion (English Translation for ISR only) mailed on Mar. 16, 2021 for International Patent Application No. PCT/JP2021/002440.

Lee, Seunghwa, et al. "Importance of Ag—Cu Biphasic Boundaries forSelective Electrochemical Reduction of CO2 to Ethanol" ACS Publications; pp. 8594-8604.

[English Translation] First Office Action for CN Application No. 202180011402.X, mailed Sep. 23, 2023; pp. all.

Notice of Reasons for Refusal for Japanese Patent Application No. 2021-574021 dated Jan. 14, 2025, pp. all.

* cited by examiner

CATHODE ELECTRODE, COMPOSITE OF CATHODE ELECTRODE AND SUBSTRATE, AND METHOD OF MANUFACTURING COMPOSITE OF CATHODE ELECTRODE AND SUBSTRATE

CROSS REFERENCE TO RELATED APPLICATIONS

The present application is a continuation application of International Patent Application No. PCT/JP2021/002440 filed on Jan. 25, 2021, which claims the benefit of Japanese Patent Application No. 2020-010873, filed on Jan. 27, 2020. The contents of these applications are incorporated herein by reference in their entirety.

BACKGROUND

Technical Field

The present disclosure relates to a cathode electrode that can electrically reduce carbon dioxide to convert carbon dioxide into an olefin such as ethylene, a composite of a cathode electrode and a substrate, and a method of manufacturing a composite of a cathode electrode and a substrate.

Background

In recent years, adverse effects due to the global warming have diversely changed the global environment, and various problematic phenomena are observed. One of the causes is considered to be a rise in concentration of greenhouse gasses in the atmosphere, specifically carbon dioxide, which mainly accounts for the greenhouse gasses. To lower the concentration of carbon dioxide in the atmosphere, not only increasing an amount of photosynthesis by new afforestation on the ground and marine algae but also actively absorbing and recovering carbon dioxide in the atmosphere has been investigated. Furthermore, not only absorbing and recovering carbon dioxide but also utilizing carbon from carbon dioxide as a raw material of organic compounds is desirable.

Specifically, it has been investigated to reduce carbon dioxide and convert it into, for example, ethylene, ethanol, carbon monoxide, methane, methanol, formic acid, and the like to be utilized in synthesis of organic substances. Among them, ethylene and ethanol, which are C2 compounds, are significantly useful as derivatives with synthesizing various organic compounds, and have higher utility value than C1 compounds such as carbon monoxide and methane.

In recent years, for the reduction reaction of carbon dioxide as above, catalysts such as photocatalysts and electrode catalysts have been commonly used, and development of a catalyst having more excellent catalytic performance is required. In a catalyst used for the reduction reaction of carbon dioxide, not only reaction efficiency but also selectivity to a specific reaction are required, and selecting a material is important from such a viewpoint (Y Hori "Electrochemical reduction of CO at a Copper Electrode." J. Phys. Chem. B. 101(36). 7075-7081 (1997)). For example, from the viewpoint of efficient reductive production of carbon monoxide to increase a rate of carbon monoxide in the reduced substances, gold, silver, and zinc are used as the catalyst material. From the viewpoint of efficient reductive production of a hydrocarbon such as methane, ethane, and ethylene, copper is used as the catalyst material. Among them, copper attracts attention as an electrode catalyst for a cathode reduction of carbon dioxide because it can produce a C2 compound such as ethylene.

Proposed as the electrode catalyst for the cathode reduction of carbon dioxide using copper is, for example, a cathode electrode for reducing carbon dioxide that inhibits diffusion of the metal element between a catalyst layer and a substrate and inhibits a side reaction of the metal and that has no deterioration of catalytic efficiency by forming a diffusion inhibiting layer composed of an organic material on the copper-based substrate and by forming the catalyst layer mainly composed of a metal cluster thereon (Japanese Patent Application Laid-Open No. 2018-168410). In Japanese Patent Application Laid-Open No. 2018-168410, disclosed is a cathode electrode for reducing carbon dioxide that inhibits diffusion of the metal element between a catalyst layer and a substrate and inhibits a side reaction of the metal and that can prevent deterioration of catalytic efficiency by forming a diffusion inhibiting layer composed of an organic material on the copper-based substrate and by forming the catalyst layer mainly composed of a metal cluster on the diffusion inhibiting layer. Meanwhile, evaluated in Example of Japanese Patent Application Laid-Open No. 2018-168410 is a Faraday efficiency of each product such as ethylene in the reduction reaction of carbon dioxide. In Japanese Patent Application Laid-Open No. 2018-168410, stably sustaining the catalytic reaction producing ethylene and the like over a long term is not verified.

To practically use the production of ethylene and the like with the reduction reaction of carbon dioxide in the industry, the catalytic reaction producing ethylene and the like is required to be stably sustained in a term as long as several hundred hours or longer. The cathode electrode for reducing carbon dioxide of Japanese Patent Application Laid-Open No. 2018-168410 has a room for improvement in the viewpoint of stably sustaining the catalytic reaction producing ethylene and the like over a long term.

SUMMARY

Considering the above situation, it is an object of the present disclosure to provide a cathode electrode that can stably sustain a catalytic reaction producing an olefinic hydrocarbon such as ethylene and an alcohol such as ethanol by the reduction reaction of carbon dioxide over a long term, a composite of the cathode electrode and a substrate, and a method of manufacturing the composite.

The spirits of constitutions of the present disclosure are as follows.

[1] A cathode electrode that electrically reduces carbon dioxide, comprising:

cuprous oxide, copper, and at least one additional metal element selected from the group consisting of silver, gold, zinc, and cadmium.

[2] A cathode electrode that electrically reduces carbon dioxide, comprising:

a cuprous oxide that is not reduced to copper; at least one additional metal element selected from the group consisting of silver, gold, zinc, and cadmium; and a cuprous oxide for reduction that is reduced to copper by a reduction treatment.

[3] A cathode electrode that electrically reduces carbon dioxide in an electrolyte solution containing carbon dioxide, comprising:

cuprous oxide, copper, and at least one additional metal element selected from the group consisting of silver, gold, zinc, and cadmium.

[4] A cathode electrode that electrically reduces carbon dioxide in an electrolyte solution containing carbon dioxide, comprising:

a cuprous oxide that is not reduced to copper; at least one additional metal element selected from the group consisting of silver, gold, zinc, and cadmium; and a cuprous oxide for reduction that is reduced to copper by a reduction treatment.

[5] The cathode electrode according to any one of [1] to [4], wherein the at least one additional metal element selected from the group consisting of silver, gold, zinc, and cadmium is a hydroxide or an oxide.

[6] The cathode electrode according to any one of [1] to [5], wherein a ratio of a maximum peak intensity among peak intensities of XRD patterns of an X-ray diffraction measurement using CuKα ray of the at least one additional metal element selected from the group consisting of silver, gold, zinc, and cadmium, a hydroxide of the at least one additional metal element selected from the group consisting of silver, gold, zinc, and cadmium, and an oxide of the at least one additional metal element selected from the group consisting of silver, gold, zinc, and cadmium, to a peak intensity of an XRD pattern of an X-ray diffraction measurement using CuKα ray of cuprous oxide is 0.20 or less.

[7] The cathode electrode according to any one of [1] to [6], wherein copper metal and a monovalent copper are present on a surface when a potential is applied within a range of +0.2 V to −1.4 V relative to a reversible hydrogen electrode in an electrolyte solution containing carbon dioxide.

[8] The cathode electrode according to any one of [1] to [7], wherein a value of the number of moles of copper/the number of moles of cuprous oxide is within a range of 2.5 to 80.

[9] The cathode electrode according to [1] or [3], wherein the cathode electrode has a porous structure.

[10] A composite of a cathode electrode and a substrate, comprising a conductive substrate, and the cathode electrode according to any one of [1] to [9] formed on the conductive substrate.

[11] The composite according to [10], wherein the conductive substrate is a copper substrate.

[12] The composite according to [11], wherein the copper substrate is a polycrystalline copper having a purity of copper of 99.9 mol % or more, and is a plate material having an average thickness of a process-modified layer of the copper substrate of 1.0 μm or less.

[13] The composite according to any one of [10] to [12], wherein the cathode electrode is a coelectrodeposition layer.

[14] A method of manufacturing a composite of a cathode electrode and a substrate, comprising:

a step of providing a conductive substrate; and a coelectrodeposition layer forming step of coelectrodepositing cuprous oxide and at least one additional metal element selected from the group consisting of silver, gold, zinc, and cadmium on the conductive substrate to form a coelectrodeposition layer.

[15] The manufacturing method according to [14], further comprising an electropolishing treatment step of performing an electropolishing treatment on the conductive substrate, wherein after the electropolishing treatment step, the coelectrodeposition layer forming step is performed.

[16] The manufacturing method according to [14] or [15], further comprising a partial reduction step of partially reducing the coelectrodeposition layer after the coelectrodeposition layer forming step.

[17] An electrolyzer that electrically reduces carbon dioxide to an olefinic hydrocarbon and/or an alcohol, comprising the cathode electrode according to any one of [1] to [9].

According to an aspect of the cathode electrode of the present disclosure, by comprising cuprous oxide, copper, and at least one additional metal element selected from the group consisting of silver, gold, zinc, and cadmium, or by comprising: a cuprous oxide that is not reduced to copper; at least one additional metal element selected from the group consisting of silver, gold, zinc, and cadmium; and a cuprous oxide for reduction that is reduced to copper by a reduction treatment, the catalytic reaction producing an olefinic hydrocarbon such as ethylene and an alcohol such as ethanol by the reduction reaction of carbon dioxide can be stably sustained over a long term. Both of ethylene and ethanol are C2 compounds, and generation of a C—C bond on the catalyst is on intermediate of the reaction pathway. Thus, since active points of the ethylene production and ethanol production are same or very close, the stabilities show a similar tendency, and in both of the ethylene production and ethanol production, the reduction reaction of carbon dioxide similarly proceeds.

According to an aspect of the cathode electrode of the present disclosure, with the ratio of the maximum peak intensity among peak intensities of XRD patterns of an X-ray diffraction measurement using CuKα ray of the at least one additional metal element selected from the group consisting of silver, gold, zinc, and cadmium, a hydroxide of the at least one additional metal element selected from the group consisting of silver, gold, zinc, and cadmium, and an oxide of the at least one additional metal element selected from the group consisting of silver, gold, zinc, and cadmium, to the peak intensity of an XRD pattern of an X-ray diffraction measurement using CuKα ray of cuprous oxide being 0.20 or less, not only the catalytic reaction producing the olefinic hydrocarbon such as ethylene and the alcohol such as ethanol can be stably sustained over a long term, but also Faraday efficiencies of producing the olefinic hydrocarbon such as ethylene and the alcohol such as ethanol increase.

According to an aspect of the cathode electrode of the present disclosure, with copper metal and a monovalent copper being present on a surface when a potential is applied within a range of +0.2 V to −1.4 V relative to a reversible hydrogen electrode in an electrolyte solution containing carbon dioxide, the catalytic reaction producing the olefinic hydrocarbon such as ethylene and the alcohol such as ethanol by the reduction reaction of carbon dioxide can be stably sustained over a further long term.

According to an aspect of the cathode electrode of the present disclosure, with the value of the number of moles of copper/the number of moles of cuprous oxide being within a range of 2.5 to 80, not only the catalytic reaction producing the olefinic hydrocarbon such as ethylene and the alcohol such as ethanol can be stably sustained over a long term, but also Faraday efficiencies of producing the olefinic hydrocarbon such as ethylene and the alcohol such as ethanol increase.

According to an aspect of the cathode electrode of the present disclosure, with the cathode electrode having a porous structure, not only the catalytic reaction producing the olefinic hydrocarbon such as ethylene and the alcohol such as ethanol can be stably sustained over a long term, but also Faraday efficiencies of producing the olefinic hydrocarbon such as ethylene and the alcohol such as ethanol increase.

According to an aspect of the composite of a cathode electrode and a substrate of the present disclosure, by comprising the cathode electrode of the present disclosure, a composite that can stably sustain the catalytic reaction producing an olefinic hydrocarbon such as ethylene and an alcohol such as ethanol by the reduction reaction of carbon dioxide over a long time can be obtained.

According to an aspect of the composite of a cathode electrode and a substrate of the present disclosure, with the substrate being a polycrystalline copper having a purity of copper of 99.9 mol % or more, and being a plate material having an average thickness of a process-modified layer of 1.0 μm or less, not only the catalytic reaction producing the olefinic hydrocarbon such as ethylene and the alcohol such as ethanol can be stably sustained over a long term, but also Faraday efficiencies of producing the olefinic hydrocarbon such as ethylene and the alcohol such as ethanol increase.

According to the method of manufacturing a composite of a cathode electrode and a substrate of the present disclosure, by comprising the coelectrodeposition layer forming step of coelectrodepositing cuprous oxide and at least one additional metal element selected from the group consisting of silver, gold, zinc, and cadmium on the conductive substrate to form a coelectrodeposition layer, a composite that can stably sustain the catalytic reaction producing an olefinic hydrocarbon such as ethylene and an alcohol such as ethanol by the reduction reaction of carbon dioxide over a long time can be manufactured.

DETAILED DESCRIPTION

[Cathode Electrode]

Figure 1:
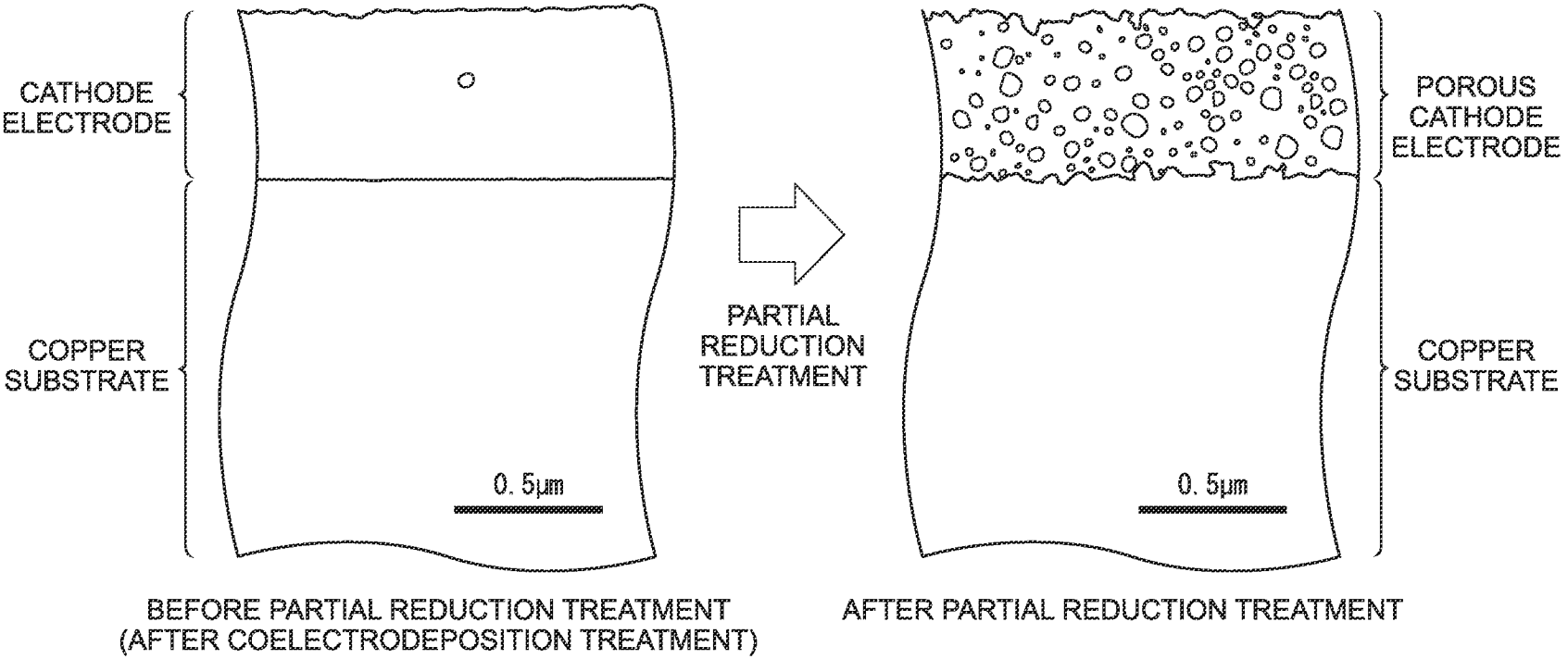
FIG. 1 An explanatory diagram schematically illustrating a cross section of the composite of the cathode electrode and the conductive substrate of the present disclosure.

The cathode electrode of the present disclosure will be described below. A first cathode electrode of the present disclosure, which is a cathode electrode that electrically reduces carbon dioxide, comprises cuprous oxide ($Cu_2O$), copper (Cu), and at least one additional metal element (M) selected from the group consisting of silver (Ag), gold (Au), zinc (Zn), and cadmium (Cd). The above first cathode electrode of the present disclosure contains cuprous oxide ($Cu_2O$), copper (Cu), and the additional metal element (M) as essential components.

By containing the cuprous oxide ($Cu_2O$), copper (Cu), and the additional metal element (M) as essential components, the first cathode electrode of the present disclosure can stably sustain the catalytic reaction producing a C2 compound such as ethylene by the reduction reaction of carbon dioxide over a long term. Furthermore, by containing cuprous oxide ($Cu_2O$), copper (Cu), and the additional metal element (M) as the essential components, the first cathode electrode of the present disclosure can stably sustain the catalytic reaction producing the olefinic hydrocarbon such as ethylene and propylene and the alcohol such as ethanol, propanol, and allyl alcohol by the reduction reaction of carbon dioxide over a long term.

A second cathode electrode of the present disclosure, which is a cathode electrode that electrically reduces carbon dioxide, comprises: a cuprous oxide ($Cu_2O$) that is not reduced to copper; at least one additional metal element (M) selected from the group consisting of silver (Ag), gold (Au), zinc (Zn), and cadmium (Cd); and a cuprous oxide for reduction ($Cu_2O$) that is reduced to copper (Cu) by a reduction treatment. In the second cathode electrode, a part of cuprous oxide ($Cu_2O$) is reduced to be copper (Cu). The above second cathode electrode of the present disclosure contains cuprous oxide ($Cu_2O$) and the additional metal element (M) as essential components. In the second cathode electrode of the present disclosure, cuprous oxide for reduction ($Cu_2O$) is reduced to be copper (Cu) by the reduction treatment to form the cathode electrode containing cuprous oxide ($Cu_2O$), copper (Cu), and at least the additional metal element (M) selected from the group consisting of silver (Ag), gold (Au), zinc (Zn), and cadmium (Cd).

An aspect of the additional metal element (M) in the cathode electrode is not particularly limited. For example, an aspect of metal itself can be mentioned, and in addition to the aspect of metal itself, an aspect of hydroxide and an aspect of oxide can be mentioned. In the additional metal element (M), the aspect of metal itself, the aspect of hydroxide, and the aspect of oxide may be mixed. Although any of silver, gold, zinc, and cadmium can be used as the additional metal element (M), zinc and silver are preferable, and zinc is particularly preferable from the viewpoint of stably sustaining the catalytic reaction producing an olefinic hydrocarbon such as ethylene and an alcohol such as ethanol over a long term. These additional metal elements (M) may be used singly, and may be used in combination of two or more thereof. Advantageous effects of the additional metal element (M) are an increase in the stability of ethylene or ethanol-producing reaction and reduction ability of $CO_2$ to CO. When a content of the additional metal element (M) in the cathode electrode becomes a predetermined amount or more, CO produced on the additional metal element (M) is released into the electrolyte to be further reduced to ethylene or ethanol. In other words, a new reaction pathway that easily produces ethylene or ethanol is considered to be provided. The additional metal element includes both of a metal element added as a raw material and a metal element deposited by the electrodeposition and the like.

When silver, gold, zinc, or cadmium is used as the additional metal element (M), a ratio between a peak intensity of an XRD pattern of an X-ray diffraction measurement using CuKα ray (hereinafter, which may be simply referred to as "XRD pattern") of cuprous oxide and a peak intensity of an XRD pattern of the additional metal element (M) is not particularly limited, and it is preferable that an upper limit of a ratio of a maximum peak intensity among peak intensities of XRD patterns of the additional metal element (M) itself, a hydroxide of the additional metal element (M), and an oxide of the additional metal element (M) to the peak intensity of the XRD pattern of cuprous oxide (hereinafter, which may be simply referred to as "peak intensity ratio of the XRD pattern") be 0.20, more preferable that it be 0.15, and particularly preferable that it be 0.10 from the viewpoint of not only ability to stably sustain the catalytic reaction producing an olefinic hydrocarbon such as ethylene and an alcohol such as ethanol, propanol, and allyl alcohol over a long term but also an increase in Faraday efficiencies of producing the olefinic hydrocarbon such as ethylene and the alcohol such as ethanol, propanol, and allyl alcohol. Meanwhile, it is preferable that a lower limit of the peak intensity ratio of the XRD pattern be 0.005, and particularly preferable that it be 0.0075 from the viewpoint of certainly increasing Faraday efficiencies of producing the olefinic hydrocarbon such as ethylene and the alcohol such as ethanol, propanol, and allyl alcohol.

In the present description, "peak intensity of the XRD pattern" means a product of a diffraction peak height of each compound phase measured by X-ray diffraction and a half width of the diffraction peak. In the present description, "maximum XRD peak intensity" means the maximum peak intensity of the XRD pattern of each compound phase. When the cathode electrode is a thin film, used for the X-ray diffraction is a measurement method suitable for measuring a thin film, for example, using "D8 DISCOVER with VANTEC2000", an X-ray microdiffraction apparatus manufactured by Bruker AXS. When the cathode electrode is a bulk body and has an enough thickness longer than the X-ray penetration, a common X-ray diffraction method may also be used.

The cathode electrode may be an aspect containing: cuprous oxide; a 0-valent copper; and at least one additional metal element (M) selected from the group consisting of silver, gold, zinc, and cadmium. In the cathode electrode in this case, a value of the number of moles of copper/the number of moles of cuprous oxide, that is a ratio of the number of moles of copper to the number of moles of cuprous oxide, is not particularly limited but it is preferable that an upper limit thereof be 80, more preferable that it be 65, and particularly preferable that it be 50 from the viewpoint of not only ability to stably sustain the catalytic reaction producing an olefinic hydrocarbon such as ethylene and an alcohol such as ethanol, propanol, and allyl alcohol over a long term but also an increase in Faraday efficiencies of producing the olefinic hydrocarbon such as ethylene and the alcohol such as ethanol, propanol, and allyl alcohol. Meanwhile, it is preferable that a lower limit of the value of the number of moles of copper/the number of moles of cuprous oxide be 2.5, and particularly preferable that it be 3.0 from the viewpoint of not only ability to stably sustain the catalytic reaction producing an olefinic hydrocarbon such as ethylene and an alcohol such as ethanol, propanol, and allyl alcohol over a long term but also an increase in Faraday efficiencies of producing an olefinic hydrocarbon such as ethylene and an alcohol such as ethanol, propanol, and allyl alcohol. By the value of the number of moles of 0-valent copper/the number of moles of cuprous oxide in the cathode electrode being within the above range, Cu and a monovalent Cu (copper of cuprous oxide) that are adjacent allocate a negative charge and a positive charge to C of a CO molecule, which is considered to be a reaction intermediate, absorbed on the cathode electrode. As a result, it is considered that an activation energy of the C—C bond formation is lowered to increase a selectivity of ethylene.

In the cathode electrode, it is preferable that copper metal and a monovalent copper be present on a surface thereof when a potential is applied within a range of +0.2 V to −1.4 V relative to a reversible hydrogen electrode in an electrolyte solution containing carbon dioxide. With the monovalent copper being present on the cathode electrode surface when the above potential is applied, the catalytic reaction producing an olefinic hydrocarbon such as ethylene and an alcohol such as ethanol, propanol, and allyl alcohol by the reduction reaction of carbon dioxide can be stably sustained over a further long term. When an electrolyzer equipped with the cathode electrode performs the reduction reaction of carbon dioxide under a constant operation condition (current value) in a long time, the potential of the cathode electrode shifts to the negative direction. With the potential of the cathode electrode shifting to the negative, when the monovalent copper ($Cu^+$) disappears, the active point of the olefinic hydrocarbon such as ethylene and the alcohol such as ethanol disappears to tend to deteriorate stability of the olefinic hydrocarbon such as ethylene and the alcohol such as ethanol. Meanwhile, even with the potential of the cathode electrode shifting to the negative, with the monovalent copper ($Cu^+$) being present, the active point of the olefinic hydrocarbon such as ethylene and the alcohol such as ethanol is sustained; thus, the stability of the olefinic hydrocarbon such as ethylene and the alcohol such as ethanol increases.

A structure of the cathode electrode may be solid and may be porous, but it is preferable that it be a porous structure from the viewpoint of not only ability to stably sustain the catalytic reaction producing an olefinic hydrocarbon such as ethylene and an alcohol such as ethanol, propanol, and allyl alcohol over a long term but also increase in Faraday efficiencies of producing the olefinic hydrocarbon such as ethylene and the alcohol such as ethanol, propanol, and allyl alcohol. A porosity of the porous structure is not particularly limited, and it is preferable that a lower limit thereof be 1% from the viewpoint of facilitation of penetration of carbon dioxide into the cathode electrode to further increase the Faraday efficiencies of producing the olefinic hydrocarbon such as ethylene and the alcohol such as ethanol, propanol, and allyl alcohol. Meanwhile, it is preferable that an upper limit of the porosity of the porous structure be 99% from the viewpoint of sustaining a surface area contributing to the catalytic reaction of the cathode electrode to further increase the Faraday efficiencies of producing the olefinic hydrocarbon such as ethylene and the alcohol such as ethanol, propanol, and allyl alcohol.

The cathode electrode of the present disclosure can electrically reduce carbon dioxide to produce the olefinic hydrocarbon such as ethylene and the alcohol such as ethanol, propanol, and allyl alcohol by applying an electrolysis potential from a power source in a state of being immersed in a cathode side electrolyte solution containing carbon dioxide.

[Composite of Cathode Electrode and Substrate]

Figure 2:
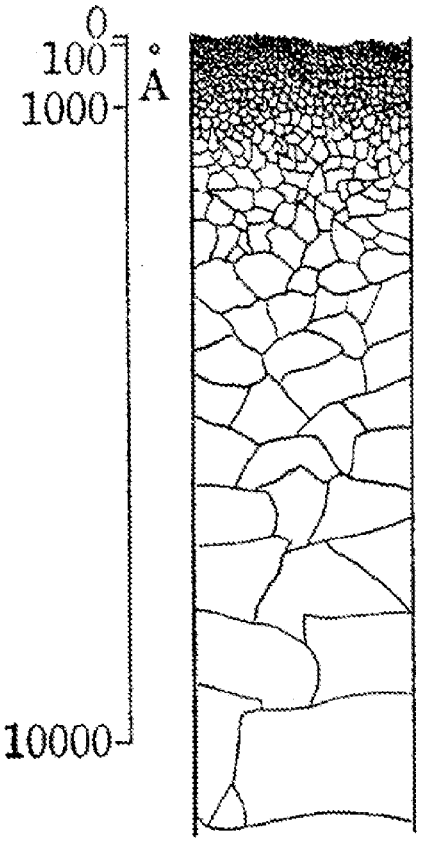
FIG. 2 An explanatory diagram schematically illustrating the process-modified layer of the conductive substrate.

The cathode electrode of the present disclosure may be used in a state of the cathode electrode alone, and may be used in a state of forming a composite with a substrate as described below. FIG. 1 is an explanatory diagram schematically illustrating a cross section of the composite of the cathode electrode and the substrate of the present disclosure. FIG. 2 is an explanatory diagram schematically illustrating a process-modified layer of the conductive substrate.

As illustrated in FIG. 1, the composite of the cathode electrode and the substrate has: the substrate; and the above cathode electrode of the present disclosure formed on the substrate. The composite of the cathode electrode and the substrate may be solid, may be porous, and may be a combination of being porous and solid. For example, a gas diffusion layer may be sandwiched between the substrate and the cathode electrode. The cathode electrode forms a coating film coating the substrate surface. In the composite of the cathode electrode and the substrate of the present disclosure, by comprising the above cathode electrode of the present disclosure, a composite that can stably sustain the catalytic reaction producing an olefinic hydrocarbon such as ethylene and an alcohol such as ethanol, propanol, and allyl alcohol by the reduction reaction of carbon dioxide over a long time can be obtained. A structure of the cathode electrode formed on the substrate may be solid and may be porous, but as described above, it is preferable that it be a porous structure from the viewpoint of not only ability to stably sustain the catalytic reaction producing an olefinic hydrocarbon such as ethylene and an alcohol such as ethanol, propanol, and allyl alcohol over a long term but also an increase in Faraday efficiencies of producing the olefinic hydrocarbon such as ethylene and the alcohol such as ethanol, propanol, and allyl alcohol. The porous structure of the cathode electrode can be formed by performing a partial reduction treatment, described later, on a cathode electrode having a solid structure.

Since energization from a power source to the cathode electrode during the electrical reduction of carbon dioxide with electrolysis is performed via the substrate, the substrate is conductive. As the conductive substrate, for example, copper (Cu), niobium (Nb), aluminum (Al), titanium (Ti), an alloy containing one or more of the above metals, stainless steel (SUS), and the like can be mentioned. Although a structure of the substrate may be solid and may be porous, it is preferable that it be a porous structure from the viewpoint of increasing the gas diffusibility. Among them, it is preferable that it be a copper substrate from the viewpoint of ability to stably sustain the catalytic reaction producing an olefinic hydrocarbon such as ethylene over a further long term. An average thickness of the substrate is not particularly limited, and a plate material with 0.2 mm or more and 1.5 mm or less can be mentioned, for example.

As the copper substrate, a polycrystalline copper having a purity of copper of 99.9 mol % or more (that is, an inevitable impurity is less than 0.1 mol %) can be mentioned. An average thickness of a process-modified layer of the copper substrate is not particularly limited, and it is preferable that it be, for example, 1.0 μm or less, more preferable that it be 0.5 μm or less, and particularly preferable that it be 0 μm from the view point of not only ability to stably sustain the catalytic reaction producing an olefinic hydrocarbon such as ethylene and an alcohol such as ethanol, propanol, and allyl alcohol over a long term but also increase in Faraday efficiencies of producing the olefinic hydrocarbon such as ethylene and the alcohol such as ethanol, propanol, and allyl alcohol. The process-modified layer can be decreased or removed by, for example, performing an electropolishing treatment of the copper substrate, as described later.

The process-modified layer is a layer in which a construction near the surface is modified compared with a construction of bulk by heat or mechanical force during a rolling of metal, mechanical processing, and the like, and is typically amorphous or has finer crystalline particles than the bulk. The process-modified layer can be specified by using a circle equivalent diameter d of a region composed of a specific crystalline plane (crystalline particle) shown as a single color in a crystal orientation mapping image when a cross section of the substrate is analyzed by electron backscatter diffraction method (EBSD). That is, in the present description, defined as "process-modified layer" is an amorphous region or a region where there are at least two crystalline particles with d 0.2 μm in an area of 1 square μm that is within 5 μm from the material surface in the crystal orientation mapping of EBSD. In addition, "average thickness of the process-modified layer" means an average of measured values at thickest positions in five different observation fields with measuring a thickness of the process-modified layer at the thickest position in the observation field of magnifying observation.

The cathode electrode in the composite of the cathode electrode and the substrate is a coelectrodeposition layer formed by, for example, immersing the substrate in a coelectrodeposition solution containing copper ions, which are a raw material of cuprous oxide, and ions of the additional metal element (M), and coelectrodepositing cuprous oxide and the additional metal element (M) on the substrate.

[Method of Manufacturing Composite of Cathode Electrode and Substrate]

Figure 3:
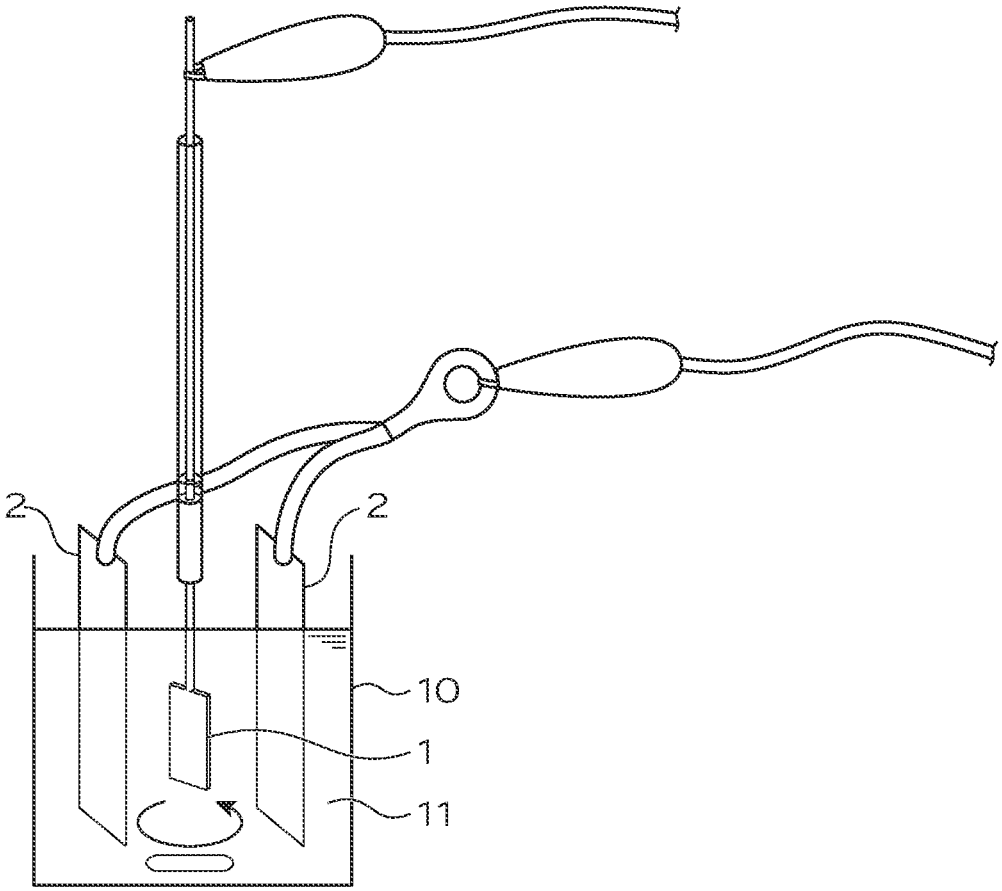
FIG. 3 An explanatory diagram of the electropolishing treatment step in the method of manufacturing a composite of a cathode electrode and a substrate.
Figure 4:
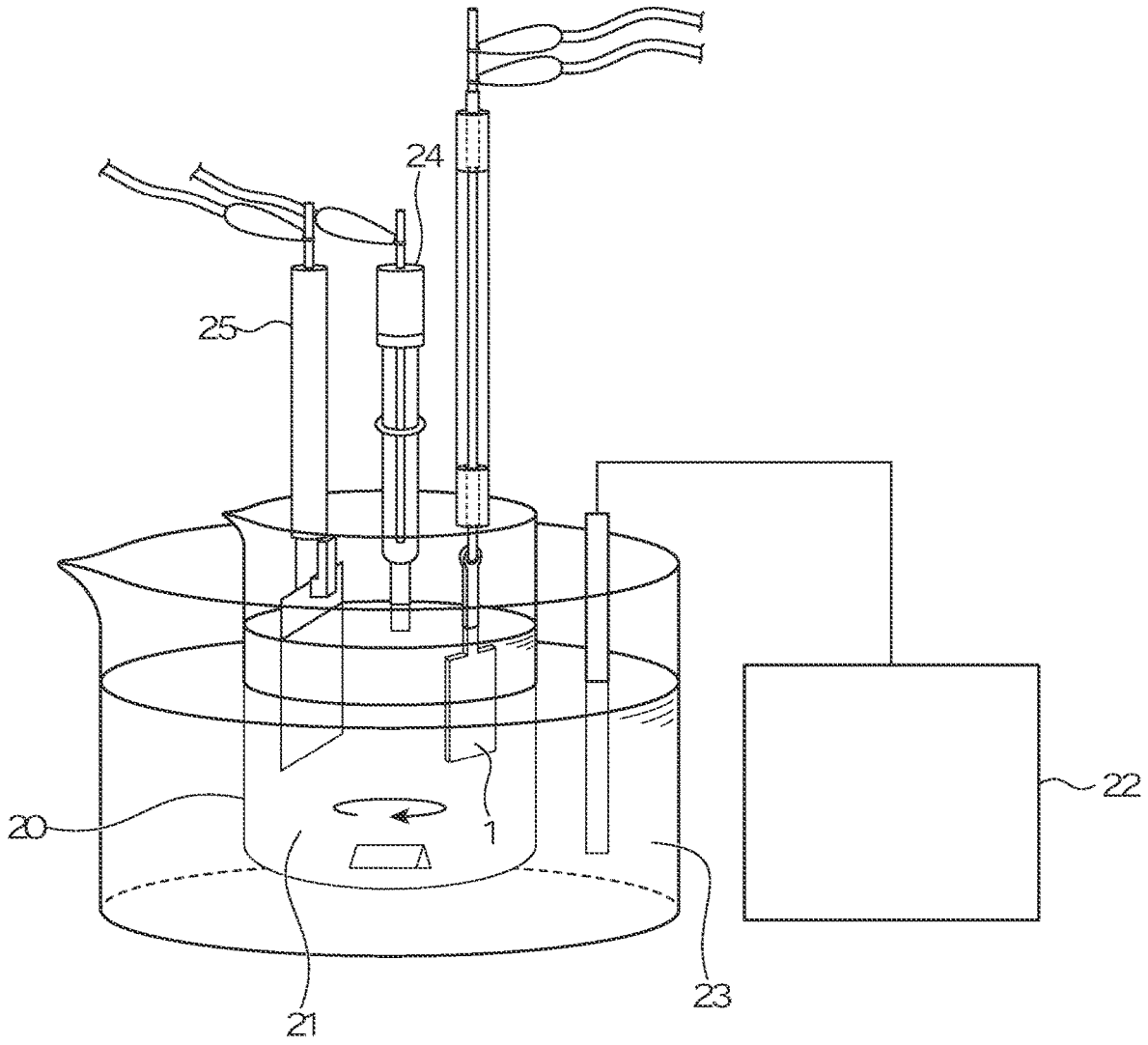
FIG. 4 An explanatory diagram of the coelectrodeposition layer forming step in the method of manufacturing a composite of a cathode electrode and a substrate.
Figure 5:
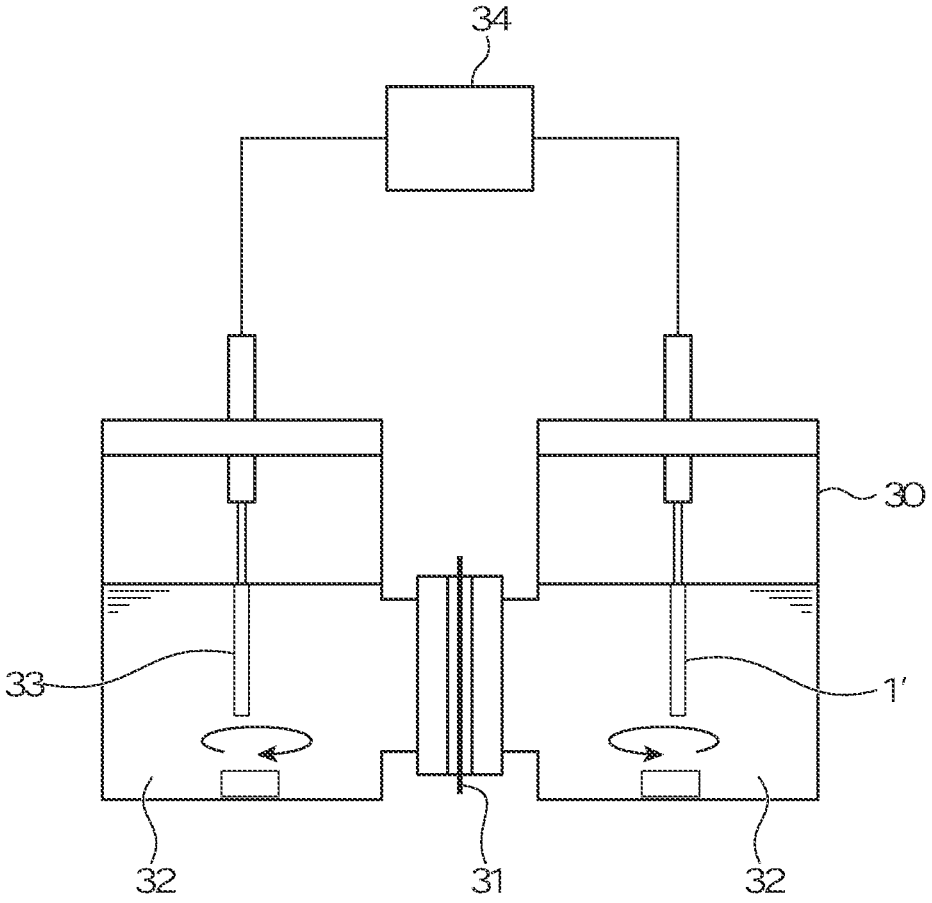
FIG. 5 An explanatory diagram of the partial reduction step in the method of manufacturing a composite of a cathode electrode and a substrate.

An example of a method of manufacturing the composite of the cathode electrode and the substrate will be described below. FIG. 3 is an explanatory diagram of the electropolishing treatment step in the method of manufacturing the composite of the cathode electrode and the substrate. FIG. 4 is an explanatory diagram of the coelectrodeposition layer forming step in the method of manufacturing the composite of the cathode electrode and the substrate. FIG. 5 is an explanatory diagram of the partial reduction step in the method of manufacturing the composite of the cathode electrode and the substrate.

The method of manufacturing the composite of the cathode electrode and the substrate comprises, for example, (1) a step of providing a conductive substrate; (2) an electropolishing treatment step of performing an electropolishing treatment on the provided conductive substrate, if necessary; (3) a coelectrodeposition layer forming step of coelectrodepositing cuprous oxide and at least one additional metal element (M) selected from the group consisting of silver, gold, zinc, and cadmium on the conductive substrate in which the electropolishing treatment has been performed if necessary, to form a coelectrodeposition layer; and (4) a partial reduction step of partially reducing the formed coelectrodeposition layer, if necessary. Among the above steps, the step (1) and the step (3) are essential steps, and the step (2) and the step (4) are optional steps.

(1) Step of Providing Conductive Substrate

The step of providing the conductive substrate is a step of providing the above substrate, and a type of the conductive substrate can be appropriately selected depending on required characteristics of the composite of the cathode electrode and the substrate.

(2) Electropolishing Treatment Step

In the electropolishing treatment step, the substrate surface is degreased with an organic solvent such as hexane, then washed and dried, thereafter as illustrated in FIG. 3, a mixed acid solution 11 is housed in a container 10, a substrate 1, which is a positive electrode, is immersed in the mixed acid solution 11, a negative electrode 2 is immersed at a position sandwiching the substrate 1, and an electrolysis potential is applied between the substrate 1, which is the positive electrode, and the negative electrode 2. By applying the electrolysis potential between the substrate 1, which is the positive electrode, and the negative electrode 2, the surface of the substrate 1 is electropolished. By electropolishing the surface of the substrate 1, the process-modified layer on the surface of the substrate 1 is decreased or removed. As the mixed acid solution 11, an aqueous mixed acid solution of phosphoric acid and sulfuric acid can be mentioned, for example. As the negative electrode 2, titanium can be mentioned, for example.

(3) Coelectrodeposition Layer Forming Step

As illustrated in FIG. 4, a coelectrodeposition aqueous solution 21 containing copper ions, the additional metal element (M), and an organic acid at a predetermined molar ratio are housed in a container 20, and a pH of the coelectrodeposition aqueous solution 21 is adjusted within a predetermined range by using an alkaline aqueous solution. By adjusting a temperature of a medium 23, such as water, in which the outer surface of the container 20 is immersed with a temperature controller 22, a temperature of the coelectrodeposition aqueous solution 21 is adjusted to 50 to 60° C. Then, the substrate 1, a reference electrode (Ag/AgCl) 24, and a counter electrode (platinum electrode) 25 are immersed in the coelectrodeposition aqueous solution 21. Thereafter, by coelectrodepositing cuprous oxide and the additional metal element (M) on the substrate 1 with controlling a current density supplied from the power source, the cathode electrode, which is the coelectrodeposition layer, is formed. An electrodeposited amount, component ratio, and the like of cuprous oxide and additional metal element (M) to be coelectrodeposited are adjustable by controlling a concentration and component ratio of the coelectrodeposition aqueous solution 21, a time of the coelectrodeposition, the current density, and the pH of the coelectrodeposition aqueous solution 21. As the alkaline aqueous solution, an aqueous sodium hydroxide solution, an aqueous potassium hydroxide solution, and the like can be mentioned, for example. As the set range of the pH, 9.0 to 11 can be mentioned, for example. As the organic acid, oxalic acid, acetic acid, lactic acid, and citric acid can be mentioned, for example.

(4) Partial Reduction Step

As illustrated in FIG. 5, a composite 1' obtained by forming the cathode electrode, which is the coelectrodeposition layer, on the substrate 1, and an anode electrode 33 are immersed in an aqueous solution for the partial reduction 32 housed in a two-chamber type electrolysis cell 30 having a diaphragm 31, and by applying an electrolysis potential from a power source 34 to the two-chamber type electrolysis cell 30, the partial reduction treatment is performed. By performing the partial reduction treatment, the cathode electrode can become porous, as illustrated in FIG. 1. As the anode electrode 33, platinum can be mentioned, for example. As the aqueous solution for the partial reduction 32, an aqueous potassium hydrogen carbonate solution can be mentioned on both the cathode electrode side and the anode electrode side, for example.

[Electrolyzer]

Thereafter, an electrolyzer that electrically reduces carbon dioxide to an olefinic hydrocarbon and/or an alcohol, comprising the cathode electrode of the present disclosure, will be described below. The electrolyzer performing the electrochemical reduction of carbon dioxide is mainly constituted with an electrolysis cell, a gas recovery apparatus, an electrolyte liquid circulator, a carbon dioxide feeding part, a power source, and the like.

The electrolysis cell is a part to reduce a target substance, also a part including the cathode electrode of the present disclosure, and a part to reduce carbon dioxide (in the solution, including a case of a hydrogen carbonate ion as well as dissolved carbon dioxide). An electrolysis power is supplied from the power source to the electrolysis cell.

The electrolyte liquid circulator is a part to circulate an electrolyte liquid on the cathode side with respect to the cathode electrode in the electrolysis cell. The electrolyte liquid circulator is, for example, a vessel and a pump, and feeds carbon dioxide from the carbon dioxide feeding part into the electrolyte liquid so as to be a predetermined carbon dioxide concentration to enable to circulate the electrolyte liquid in the electrolysis cell.

As the electrolyte liquid on the cathode side in the electrolysis cell, it is preferable that it be an electrolyte liquid that can dissolves a large amount of carbon dioxide, and for example, alkaline solutions such as an aqueous sodium hydroxide solution, an aqueous potassium hydroxide solution, sodium carbonate, potassium carbonate, sodium hydrogen carbonate, and potassium hydrogen carbonate, monomethanolamine, methylamine, other liquid amines, a mixed liquid of these liquid amines and an aqueous electrolyte liquid, and the like can be mentioned. As the electrolyte liquid on the cathode side, acetonitrile, benzonitrile, methylene chloride, tetrahydrofuran, propylene carbonate, dimethylformamide, dimethyl sulfoxide, methanol, ethanol, and the like can also be used. As the electrolyte liquid on the anode side in the electrolysis cell, the same electrolyte liquid as the above cathode electrolyte liquid can be mentioned, for example.

The gas recovery apparatus is a part to recover gas produced by the reduction with the electrolysis cell. In the gas recovery apparatus, gasses such as an olefinic hydrocarbon and an alcohol that are produced on the cathode electrode immersed in the electrolyte liquid in the electrolysis cell can be collected. The gas recovery apparatus may have a constitution separating the recovered gases into each different gas to recover it.

A function of the electrolyzer is as follows. The electrolysis potential is applied from the power source to the electrolysis cell. The electrolyte liquid is fed to the cathode electrode in the electrolysis cell by the electrolyte liquid circulator. On the cathode electrode in the electrolysis cell, carbon dioxide in the fed electrolyte liquid is reduced. By reducing carbon dioxide, carbon-containing substances such as an olefinic hydrocarbon such as ethylene and an alcohol such as ethanol are produced. The carbon-containing substance produced on the cathode electrode is recovered by the gas recovery apparatus. In the gas recovery apparatus, the gases can be separated to be stored if necessary.

EXAMPLES

Thereafter, Examples of the present disclosure will be described. The present disclosure is not limited to the following Examples.

Example 1

Preparation of Cathode Electrode

Electropolishing Treatment Step

A surface of a commercially available oxygen-free copper, which was a polycrystalline copper having a purity of 99.9 mol % or more, was degreased with hexane, and then washed and dried. With the electropolishing apparatus illustrated in FIG. 3, by using an aqueous mixed acid solution of phosphoric acid and sulfuric acid as the mixed acid solution, titanium, which was the negative electrode, was disposed so as to sandwich a copper substrate, which was the positive electrode, and the electropolishing treatment on the copper substrate was performed to remove the process-modified layer on the copper substrate surface. As the electron backscatter diffraction method (EBSD) measurement apparatus for measuring the average thickness of the process-modified layer, OIM5.0 HIKARI, manufactured by TexSEM Laboratories (TSL), was used.

Coelectrodeposition Layer Forming Step

With the coelectrodeposition apparatus illustrated in FIG. 4, a temperature of a coelectrodeposition aqueous solution mainly containing copper sulfate and zinc sulfate whose pH was adjusted to 9.5 to 10 by using an aqueous sodium hydroxide solution was adjusted to 50 to 60° C. by adjusting a temperature of water, which was a medium, with a temperature controller, then the copper substrate subjected to the electropolishing treatment step, a reference electrode (Ag/AgCl), and a counter electrode (platinum electrode) were installed in the coelectrodeposition aqueous solution, and by coelectrodepositing copper, cuprous oxide, and zinc (an aspect of hydroxide and/or oxide) on the copper substrate with controlling the current density, a cathode electrode, which was the coelectrodeposition layer, was prepared on the copper substrate, thereby manufacturing a composite of the cathode electrode and the substrate.

Partial Reduction Step

On the cathode electrode formed on the copper substrate, with a two-chamber type electrolysis cell having a diaphragm illustrated in FIG. 5, the partial reduction treatment was performed on the cathode electrode to allow the cathode electrode to be porous by electrolysis using platinum as the anode electrode and aqueous potassium hydrogen carbonate solution as aqueous solutions for the partial reduction on both the cathode electrode side and the anode electrode side.

[Continuous Electrolysis Test]

Figure 6:
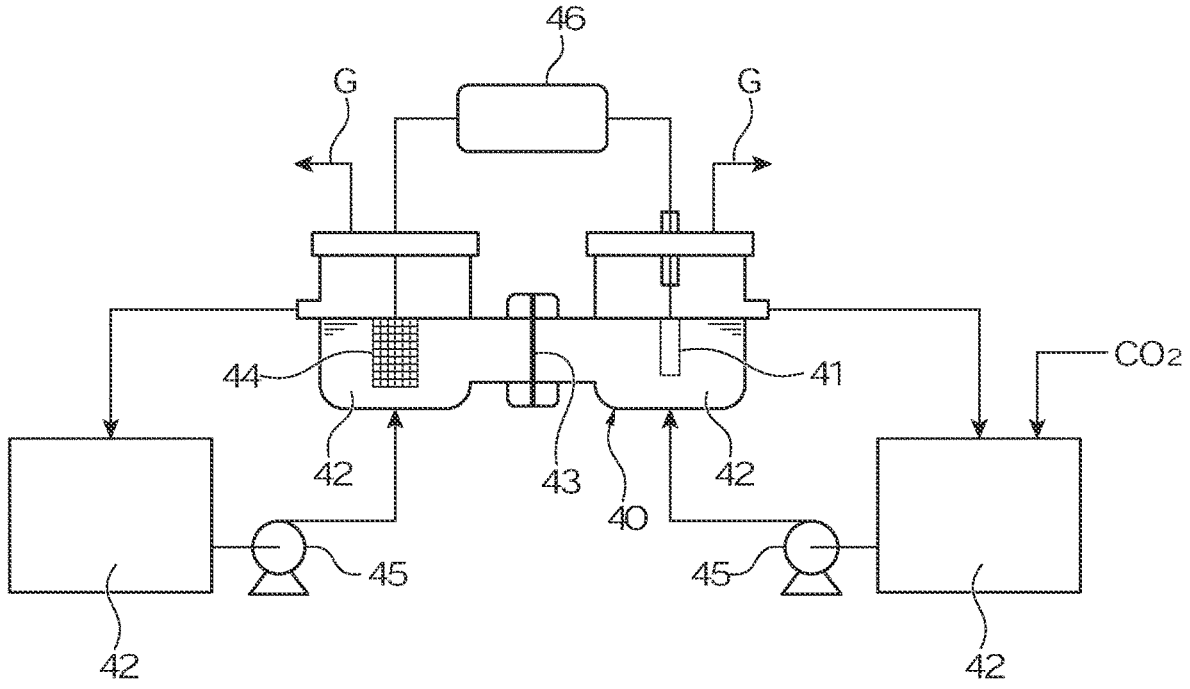
FIG. 6 An explanatory diagram of a continuous electrolysis tester used in a continuous electrolysis test.
Figure 7:
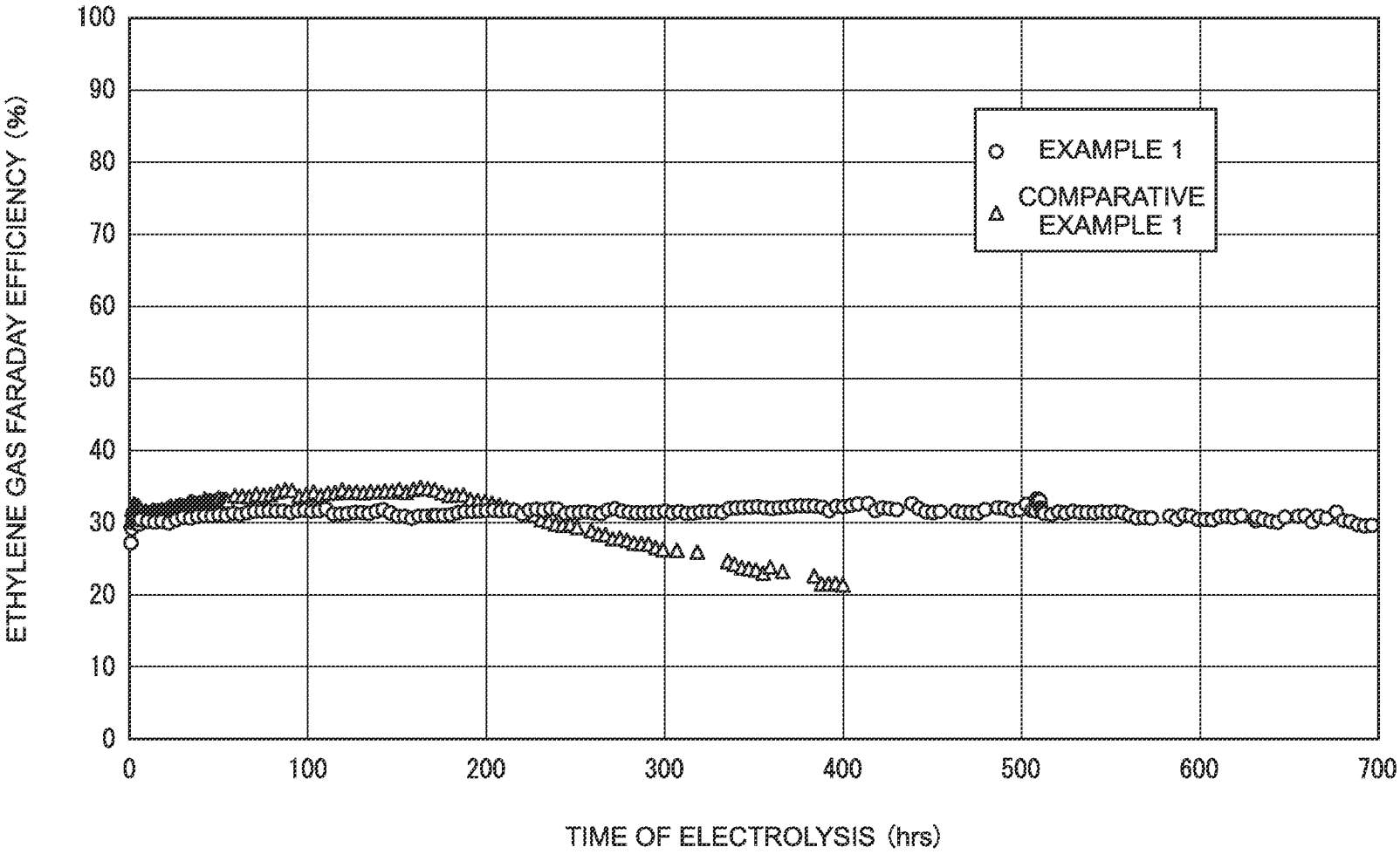
FIG. 7 A graph indicating results of the continuous electrolysis tests of Example 1 and Comparative Example 1.

As illustrated in FIG. 6, on a composite 41 of the porous cathode electrode and the substrate, the continuous electrolysis test was performed with an aqueous potassium hydrogen carbonate solution into which $CO_2$ gas was fed as an electrolyte liquid 42, by applying an electrolysis potential from a power source 46 to the porous cathode electrode and an anode electrode 44, and by feeding the electrolyte liquid 42 into the two-chamber type continuous electrolyzer 41 having a diaphragm 43 with a pump 45. That is, an aqueous potassium hydrogen carbonate solution was used as the electrolyte liquid 42 on both of the cathode electrode side and the anode electrode 44 side. As the anode electrode 44, a platinum electrode was used. In this time, the electrolysis operation was continuously performed for 700 hours, and gas G produced from the cathode electrode was continuously introduced into the gas recovery apparatus to perform gas composition analysis. A measurement result of a Faraday efficiency of ethylene gas obtained by the gas composition analysis is shown in FIG. 7.

Shown in Table 1 is each of a peak intensity ratio of the XRD pattern, a molar ratio of $Cu/Cu_2O$ after the partial reduction treatment, the average thickness of the process-modified layer, a Faraday efficiency of ethylene gas after 30 hours, a time at which the Faraday efficiency of ethylene gas was lowered to 90% of that at the beginning of the continuous electrolysis test (ethylene stability), a Faraday efficiency of ethanol after 30 hours, a Faraday efficiency of propanol after 30 hours, and a Faraday efficiency of allyl alcohol after 30 hours.

The X-ray diffraction was measured by using "D8 DISCOVER with VENTEC2000", an X-ray microdiffraction apparatus manufactured by Bruker AXS. The molar ratio of $Cu/Cu_2O$ was determined by measuring a Cu-LMM peaks (Augur electron peaks) and peak separation using "PHI Quantes", XPS (X-ray photoelectron spectroscopy) apparatus manufactured by ULVAC-PHI, Inc. (the measurement radiation source was AlKα ray (hv=1486.6 eV), a take-off angle was 90 degree). The peak separation of the Cu-LMM peaks obtained by the measurement was performed by using Cu metal, $Cu_2O$, and CuO as reference substances, and determining a coefficient of a liner combination with the least-square method. The Faraday efficiency was calculated from a rate between a total amount of electrons flown during the electrolysis test and an amount of the produced gas quantified with a gas chromatograph.

Measurement of Monovalent Cu ($Cu^+$)

In the above electrolysis test using the continuous electrolyzer 41 illustrated in FIG. 6, microscopic Raman observation of species on the cathode electrode surface was performed with a 0.1 M aqueous potassium hydrogen carbonate solution saturated with $CO_2$ gas as the electrolyte liquid 42, applying a potential to the cathode electrode within a range of +0.2 V to −1.4 V relative to a reversible hydrogen electrode (RHE), and using excited laser light at 785 nm (10 mW). A change width of the electrode potential when the potential was applied was set to be 0.2 V. The presence of the monovalent copper was confirmed by an observed Raman band (Raman peak) assigned to $Cu^+$ in 550 $cm^{-1}$ to 400 $cm^{-1}$. The above measurement condition was a condition imitating the in-situ $CO_2$ reduction reaction occurred on the cathode electrode. The measurement result of presence/absence of the Raman peak of $Cu^+$ is shown in Table 1. In Table 1, a case where the Raman peak of $Cu^+$ is observed is described as "○", and a case where no Raman peak of $Cu^+$ is observed is described as "x".

Examples 2 and 3

A composite of a cathode electrode and a substrate was manufactured to prepare a cathode electrode having a ratio of the maximum peak intensity among XRD peak intensities of zinc metal, oxide of zinc, and hydroxide of zinc in the coelectrodeposition layer to the XRD peak intensity of $Cu_2O$ (that is, peak intensity ratio of the XRD pattern) of 0.10 or less by performing an operation same as in Example 1 except that: the coelectrodeposition aqueous solution and the time of the coelectrodeposition in Example 1 were changed; and a zinc content in the cathode electrode was changed. A continuous electrolysis test same as in Example 1 was performed by using the above electrode to measure a Faraday efficiency of ethylene gas after 30 hours, an ethylene stability, a Faraday efficiency of ethanol after 30 hours, a Faraday efficiency of propanol after 30 hours, and a Faraday efficiency of allyl alcohol after 30 hours. A peak intensity ratio of the XRD pattern, a molar ratio of $Cu/Cu_2O$ after the partial reduction treatment, and an average thickness of the process-modified layer were also measured similarly to Example 1. Measurement results are shown in Table 1.

The microscopic Raman observation was performed similarly to Example 1 to measure presence/absence of the monovalent Cu. A measurement result is shown in Table 1.

Examples 4 and 5

A composite of a cathode electrode and a substrate was manufactured to prepare a cathode electrode having a peak intensity ratio of the XRD pattern of 0.10 or less by performing an operation same as in Example 1 except that: the coelectrodeposition aqueous solution and the time of the coelectrodeposition in Example 1 were changed; zinc in the cathode electrode was substituted with silver; and a silver content in the cathode electrode was changed. A continuous electrolysis test same as in Example 1 was performed by using the above electrode to measure a Faraday efficiency of ethylene gas after 30 hours, an ethylene stability, a Faraday efficiency of ethanol after 30 hours, a Faraday efficiency of propanol after 30 hours, and a Faraday efficiency of allyl alcohol after 30 hours. A peak intensity ratio of the XRD pattern, a molar ratio of $Cu/Cu_2O$ after the partial reduction treatment, and an average thickness of the process-modified layer were also measured similarly to Example 1. Measurement results are shown in Table 1.

Examples 6, 7, and 8

A composite of a cathode electrode and a substrate was manufactured to prepare a cathode electrode having a molar ratio of $Cu/Cu_2O$ in the cathode electrode of 3.0 to 50 by performing an operation same as in Example 1 except that: the condition of the partial reduction was changed; and the molar ratio of $Cu/Cu_2O$ contained in the cathode electrode was changed. A continuous electrolysis test same as in Example 1 was performed by using the above electrode to measure a Faraday efficiency of ethylene gas after 30 hours, an ethylene stability, a Faraday efficiency of ethanol after 30 hours, a Faraday efficiency of propanol after 30 hours, and a Faraday efficiency of allyl alcohol after 30 hours. A peak intensity ratio of the XRD pattern, a molar ratio of $Cu/Cu_2O$ after the partial reduction treatment, and an average thickness of the process-modified layer were also measured similarly to Example 1. Measurement results are shown in Table 1.

Examples 9 and 10

A composite of a cathode electrode and a substrate was manufactured to prepare a cathode electrode formed on the substrate having the process-modified layer by performing an operation same as in Example 1 except that the time of the electropolishing in Example 1 was shortened for remaining the process-modified layer of the substrate to set the average thickness of the process-modified layer to be 1.0 μm or less. A continuous electrolysis test same as in Example 1 was performed by using the above electrode to measure a Faraday efficiency of ethylene gas after 30 hours, an ethylene stability, a Faraday efficiency of ethanol after 30 hours, a Faraday efficiency of propanol after 30 hours, and a Faraday efficiency of allyl alcohol after 30 hours. A peak intensity ratio of the XRD pattern, a molar ratio of $Cu/Cu_2O$ after the partial reduction treatment, and an average thickness of the process-modified layer were also measured similarly to Example 1. Measurement results are shown in Table 1.

Examples 11 and 12

A composite of a cathode electrode and a substrate was manufactured to prepare a cathode electrode having a peak intensity ratio of the XRD pattern of 0.20 by performing an operation same as in Example 1 except that: the coelectrodeposition aqueous solution and the time of the coelectrodeposition in Example 1 or 4 was changed; and a zinc or silver content in the cathode electrode was changed. A continuous electrolysis test same as in Example 1 was performed by using the above electrode to measure a Faraday efficiency of ethylene gas after 30 hours, an ethylene stability, a Faraday efficiency of ethanol after 30 hours, a Faraday efficiency of propanol after 30 hours, and a Faraday efficiency of allyl alcohol after 30 hours. A peak intensity ratio of the XRD pattern, a molar ratio of $Cu/Cu_2O$ after the partial reduction treatment, and an average thickness of the process-modified layer were also measured similarly to Example 1. Measurement results are shown in Table 1.

Examples 13 and 14

A composite of a cathode electrode and a substrate was manufactured to prepare a cathode electrode having a molar ratio of $Cu/Cu_2O$ of each 2.0 and 100 by performing an operation same as in Example 1 except that: the condition of the partial reduction in Example 1 was changed; and the molar ratio between Cu and $Cu_2O$ contained in the cathode electrode was changed. A continuous electrolysis test same as in Example 1 was performed by using the above electrode to measure a Faraday efficiency of ethylene gas after 30 hours, an ethylene stability, a Faraday efficiency of ethanol after 30 hours, a Faraday efficiency of propanol after 30 hours, and a Faraday efficiency of allyl alcohol after 30 hours. A peak intensity ratio of the XRD pattern, a molar ratio of $Cu/Cu_2O$ after the partial reduction treatment, and an average thickness of the process-modified layer were also measured similarly to Example 1. Measurement results are shown in Table 1.

Example 15

A composite of a cathode electrode and a substrate was manufactured to prepare a cathode electrode formed on the substrate having the process-modified layer by performing an operation same as in Example 1 except that the time of the electropolishing in Example 1 was shortened to set the average thickness of the process-modified layer of the substrate to be 1.5 μm. A continuous electrolysis test same as in Example 1 was performed by using the above electrode to measure a Faraday efficiency of ethylene gas after 30 hours, an ethylene stability, a Faraday efficiency of ethanol after 30 hours, a Faraday efficiency of propanol after 30 hours, and a Faraday efficiency of allyl alcohol after 30 hours. A peak intensity ratio of the XRD pattern, a molar ratio of $Cu/Cu_2O$ after the partial reduction treatment, and an average thickness of the process-modified layer were also measured similarly to Example 1. Measurement results are shown in Table 1.

Examples 16 to 19

A composite of a cathode electrode and a substrate was manufactured to prepare a cathode electrode having a peak intensity ratio of the XRD pattern of 0.50 or 1.0 by performing an operation same as in Example 1 except that: the coelectrodeposition aqueous solution and the time of the coelectrodeposition in Example 1 or 4 were changed; and a zinc or silver content in the cathode electrode was changed. A continuous electrolysis test same as in Example 1 was performed by using the above electrode to measure a Faraday efficiency of ethylene gas after 30 hours, an ethylene stability, a Faraday efficiency of ethanol after 30 hours, a Faraday efficiency of propanol after 30 hours, and a Faraday efficiency of allyl alcohol after 30 hours. A peak intensity ratio of the XRD pattern, a molar ratio of $Cu/Cu_2O$ after the partial reduction treatment, and an average thickness of the process-modified layer were also measured similarly to Example 1. Measurement results are shown in Table 1.

Comparative Example 1

A composite of a cathode electrode and a substrate was manufactured to prepare a cathode electrode not containing the additional metal element by performing an operation same as in Example 1 except that the coelectrodeposition aqueous solution in Example 1 contained no zinc sulfate. A continuous electrolysis test same as in Example 1 was performed by using the above electrode to measure a Faraday efficiency of ethylene gas after 30 hours, an ethylene stability, a Faraday efficiency of ethanol after 30 hours, a Faraday efficiency of propanol after 30 hours, and a Faraday efficiency of allyl alcohol after 30 hours. A peak intensity ratio of the XRD pattern, a molar ratio of $Cu/Cu_2O$ after the partial reduction treatment, and an average thickness of the process-modified layer were also measured similarly to Example 1. Measurement results are shown in Table 1. A measurement result of a Faraday efficiency of ethylene gas obtained by the gas composition analysis in the continuous electrolysis test is shown in FIG. 7.

The microscopic Raman observation was performed similarly to Example 1 to measure presence/absence of the monovalent Cu. A measurement result is shown in Table 1.

TABLE 1

| | Constitution element in cathode electrode before partial reduction treatment (excluding cuprous oxide) | Constitution element in cathode electrode after partial reduction treatment (excluding cuprous oxide) | Peak intensity ratio $M/Cu_2O$ | $Cu/Cu_2O$ mixing molar ratio after partial reduction treatment | Thickness of process-modified layer (mm) | Ethylene Faraday efficiency (%) | Ethylene stability (h) | Presence/absence of monovalent copper | Ethanol Faraday efficiency (%) | Propanol Faraday efficiency (%) | Ally alcohol Faraday efficiency (%) |
|---|---|---|---|---|---|---|---|---|---|---|---|
| Example 1 | Zn | Zn, Cu metal | 0.01 | 10 | 0 | 31 | >1000 | ○ | 9 | 7 | 2 |
| Example 2 | Zn | Zn, Cu metal | 0.08 | 10 | 0 | 23 | >500 | x | 6 | 5 | 2 |
| Example 3 | Zn | Zn, Cu metal | 0.12 | 10 | 0 | 14 | >500 | x | 5 | 5 | 1 |
| Example 4 | Ag | Ag, Cu metal | 0.01 | 10 | 0 | 32 | >500 | — | 10 | 7 | 2 |
| Example 5 | Ag | Ag, Cu metal | 0.08 | 10 | 0 | 23 | >500 | — | 5 | 5 | 2 |
| Example 6 | Zn | Zn, Cu metal | 0.01 | 3 | 0 | 27 | >500 | — | 9 | 6 | 2 |
| Example 7 | Zn | Zn, Cu metal | 0.01 | 20 | 0 | 30 | >500 | — | 7 | 7 | 2 |
| Example 8 | Zn | Zn, Cu metal | 0.01 | 50 | 0 | 30 | >500 | — | 8 | 8 | 2 |
| Example 9 | Zn | Zn, Cu metal | 0.01 | 10 | 0.5 | 22 | >500 | — | 7 | 5 | 2 |
| Example 10 | Zn | Zn, Cu metal | 0.01 | 10 | 1 | 16 | >500 | — | 5 | 5 | 1 |
| Example 11 | Zn | Zn, Cu metal | 0.2 | 10 | 0 | 7 | >500 | — | 1 | 1 | 1 |
| Example 12 | Ag | Ag, Cu metal | 0.2 | 10 | 0 | 4 | >500 | — | 1 | 1 | 0 |
| Example 13 | Zn | Zn, Cu metal | 0.01 | 2 | 0 | 8 | >500 | — | 1 | 1 | 1 |
| Example 14 | Zn | Zn, Cu metal | 0.01 | 100 | 0 | 5 | >500 | — | 1 | 0 | 0 |
| Example 15 | Zn | Zn, Cu metal | 0.01 | 10 | 1.5 | 4 | >500 | — | 1 | 0 | 0 |
| Comparative Example 1 | — | Cu metal | — | 10 | 0 | 30 | 200 | x | 7 | 4 | 2 |
| Example 16 | Zn | Zn, Cu metal | 0.5 | 10 | 0 | 3 | >500 | — | 1 | 0 | 0 |
| Example 17 | Zn | Zn, Cu metal | 1 | 10 | 0 | 4 | >500 | — | 1 | 0 | 0 |
| Example 18 | Ag | Ag, Cu metal | 0.5 | 10 | 0 | 4 | >500 | — | 1 | 0 | 0 |
| Example 19 | Ag | Ag, Cu metal | 1 | 10 | 0 | 2 | >500 | — | 1 | 0 | 0 |

As shown in Table 1, with the cathode electrode of Examples 1 to 19, which contained cuprous oxide and zinc or silver, which were the additional metal element (M), the ethylene stability was longer than 500 hours, and accordingly the catalytic reaction producing ethylene by the reduction reaction of carbon dioxide was able to be stably sustained over a long term. When the additional metal (M) was zinc, from comparison between Examples 1 to 3 and 11 and Examples 16 to 17, with the cathode electrode having the peak intensity ratio of the XRD pattern of 0.2 or less, the Faraday efficiency of ethylene gas further increased. In particular, from comparison between Examples 1 to 5 and Examples 11 and 12, with the cathode electrode having the peak intensity ratio of the XRD pattern of 0.10 or less, the Faraday efficiency of ethylene gas, the Faraday efficiency of ethanol, the Faraday efficiency of propanol, and the Faraday efficiency of allyl alcohol also increased. From comparison between Examples 1 to 8 and Examples 13 and 14, with the cathode electrode having the molar ratio of $Cu/Cu_2O$ of 3.0 to 50, the Faraday efficiency of ethylene gas, the Faraday efficiency of ethanol, the Faraday efficiency of propanol, and the Faraday efficiency of allyl alcohol also increased. From comparison between Examples 1, 9, and 10 and Example 15, with the cathode electrode having the average thickness of the process-modified layer of 1.0 μm or less, the Faraday efficiency of ethylene gas, the Faraday efficiency of ethanol, the Faraday efficiency of propanol, and the Faraday efficiency of allyl alcohol also increased. From comparison between Example 1 and Examples 2 and 3, with the cathode electrode in which the monovalent Cu was observed even by applying the potential to the cathode electrode within a range of +0.2 V to −1.4 V relative to the reversible hydrogen electrode (RHE), the ethylene stability was longer than 1000 hours, and accordingly the catalytic reaction producing ethylene by the reduction reaction of carbon dioxide was able to be stably sustained over a further long term.

Meanwhile, with the cathode electrode of Comparative Example 1, which did not contain the additional metal element (M), the ethylene stability was limited to 250 hours, and the catalytic reaction producing ethylene was not able to be sustained over a long term. With the cathode electrode of Comparative Example 1, the monovalent Cu was not observed when the potential was applied within a range of +0.2 V to −1.4 V relative to the reversible hydrogen electrode (RHE).

The cathode electrode of the present disclosure can stably sustain the catalytic reaction producing the olefinic hydrocarbon such as ethylene and the alcohol such as ethanol by the reduction reaction of carbon dioxide; thus, it has high utility value in the field where carbon dioxide in the atmosphere is absorbed and recovered to produce industrially useful organic compounds from the carbon dioxide.

What is claimed is:

1. A cathode electrode that electrically reduces carbon dioxide, comprising:

cuprous oxide, copper, and at least one additional metal element selected from the group consisting of silver, gold, zinc, and cadmium, wherein the at least one additional metal element selected from the group consisting of silver, gold, zinc, and cadmium is a hydroxide or an oxide, and a ratio of a maximum peak intensity among peak intensities of XRD patterns of an X-ray diffraction measurement using CuKα ray of the hydroxide of the at least one additional metal element selected from the group consisting of silver, gold, zinc, and cadmium, and the oxide of the at least one additional metal element selected from the group consisting of silver, gold, zinc, and cadmium, to a peak intensity of an XRD pattern of an X-ray diffraction measurement using CuKα ray of cuprous oxide is 0.20 or less.

2. The cathode electrode according to claim 1, wherein copper metal and a monovalent copper are present on a surface when a potential is applied within a range of +0.2 V to −1.4 V relative to a reversible hydrogen electrode in an electrolyte solution containing carbon dioxide.

3. The cathode electrode according to claim 1, wherein a value of the number of moles of copper/the number of moles of cuprous oxide is within a range of 2.5 to 80.

4. The cathode electrode according to claim 1, wherein the cathode electrode has a porous structure.

5. A composite of the cathode electrode according to claim 1 and a substrate, comprising a conductive substrate, and the cathode electrode according to claim 1 formed on the conductive substrate.

6. The composite according to claim 5, wherein the conductive substrate is a copper substrate.

7. The composite according to claim 6, wherein the copper substrate is a polycrystalline copper having a purity of copper of 99.9 mol % or more, and is a plate material having an average thickness of a process-modified layer of the copper substrate of 1.0 μm or less.

8. The composite according to claim 5, wherein the cathode electrode is a coelectrodeposition layer.

9. An electrolyzer that electrically reduces carbon dioxide to an olefinic hydrocarbon and/or an alcohol, comprising the cathode electrode according to claim 1.

10. The cathode electrode according to claim 1, further comprising an additional metal element selected from the group consisting of silver, gold, zinc, and cadmium.

11. A cathode electrode that electrically reduces carbon dioxide, comprising:

a cuprous oxide that is not reduced to copper; at least one additional metal element selected from the group consisting of silver, gold, zine, and cadmium; and a cuprous oxide for reduction that is reduced to copper by a reduction treatment, wherein the at least one additional metal element selected from the group consisting of silver, gold, zinc, and cadmium is a hydroxide or an oxide, and a ratio of a maximum peak intensity among peak intensities of XRD patterns of an X-ray diffraction measurement using CuKα, ray of the hydroxide of the at least one additional metal element selected from the group consisting of silver, gold, zinc, and cadmium, and the oxide of the at least one additional metal element selected from the group consisting of silver, gold, zinc, and cadmium, to a peak intensity of an XRD pattern of an X-ray diffraction measurement using CuKα ray of cuprous oxide is 0.20 or less.

12. A cathode electrode that electrically reduces carbon dioxide in an electrolyte solution containing carbon dioxide, comprising:

cuprous oxide, copper, and at least one additional metal element selected from the group consisting of silver, gold, zinc, and cadmium, wherein the at least one additional metal element selected from the group consisting of silver, gold, zinc, and cadmium is a hydroxide or an oxide, and a ratio of a maximum peak intensity among peak intensities of XRD patterns of an X-ray diffraction measurement using CuKα ray of the hydroxide of the at least one additional metal element selected from the group consisting of silver, gold, zinc, and cadmium, and the oxide of the at least one additional metal element selected from the group consisting of silver, gold, zinc and cadmium, to a peak intensity of an XRD pattern of an X-ray diffraction measurement using CuKα ray of cuprous oxide is 0.20 or less.

13. A cathode electrode that electrically reduces carbon dioxide in an electrolyte solution containing carbon dioxide, comprising:

a cuprous oxide that is not reduced to copper; at least one additional metal element selected from the group consisting of silver, gold, zinc, and cadmium; and a cuprous oxide for reduction that is reduced to copper by a reduction treatment, wherein the at least one additional metal element selected from the group consisting of silver, gold, zinc, and cadmium is a hydroxide or an oxide, and a ratio of a maximum peak intensity among peak intensities of XRD patterns of an X-ray diffraction measurement using CuKα ray of the hydroxide of the at least one additional metal element selected from the group consisting of silver, gold, zinc, and cadmium, and the oxide of the at least one additional metal element selected from the group consisting of silver, gold, zinc, and cadmium, to a peak intensity of an XRD pattern of an X-ray diffraction measurement using CuKα ray of cuprous oxide is 0.20 or less.

* * * * *